US005277776A

United States Patent [19]

Borner et al.

[11] Patent Number: 5,277,776

[45] Date of Patent: Jan. 11, 1994

[54] POWER LEAD FOR AN ELECTRODE

[75] Inventors: Ferdinand Borner; Gerhard Klose, both of Freigericht; Karlheinz Lofink, Hasselroth, all of Fed. Rep. of Germany

[73] Assignee: Heraeus Electrochemie GmbH, Hanau, Fed. Rep. of Germany

[21] Appl. No.: 44,879

[22] Filed: Apr. 6, 1993

Related U.S. Application Data

[63] Continuation of Ser. No. 730,627, Jul. 16, 1991, abandoned.

[30] Foreign Application Priority Data

Aug. 9, 1990 [DE] Fed. Rep. of Germany ..... 4025253

[51] Int. Cl.[5] ..... C25B 9/02; C25B 9/00

[52] U.S. Cl. ..... 204/279; 204/286; 204/297 R; 204/280

[58] Field of Search ..... 204/279, 280, 290 F, 289, 286, 288, 297 R

[56] References Cited

U.S. PATENT DOCUMENTS

| | | | |
|---|---|---|---|
| 3,836,438 | 9/1974 | Sartre et al. | 204/279 |
| 3,940,328 | 2/1976 | Thomas | 204/283 |
| 4,409,086 | 10/1983 | Haas | 204/269 |
| 4,460,450 | 7/1984 | Koziol et al. | 204/290 F |
| 4,673,479 | 6/1987 | Morris et al. | 204/279 |
| 5,094,735 | 3/1992 | Lang, Jr. | 204/286 |
| 5,135,633 | 8/1992 | Kotowski et al. | 204/286 |

FOREIGN PATENT DOCUMENTS

| | | |
|---|---|---|
| 0089475 | 9/1983 | European Pat. Off. . |
| 2218941 | 9/1974 | France . |

*Primary Examiner*—Kathryn Gorgos

*Attorney, Agent, or Firm*—Frishauf, Holtz, Goodman & Woodward

[57] ABSTRACT

A power lead for electrodes in electrochemical cells has a core of a material, such as copper, that has good electrical conductivity; the core is surrounded with large-area contact by a tubular titanium body, and the surface remote from the core of the titanium body is connected to the electrode. The titanium body has an opening through which a titanium retaining pin is introduced into a recess of the core, and the rim of the opening is welded in a hermetically sealed manner to the metal pin. A preferred application is the construction or repair of anodes for diaphragm cells.

12 Claims, 1 Drawing Sheet

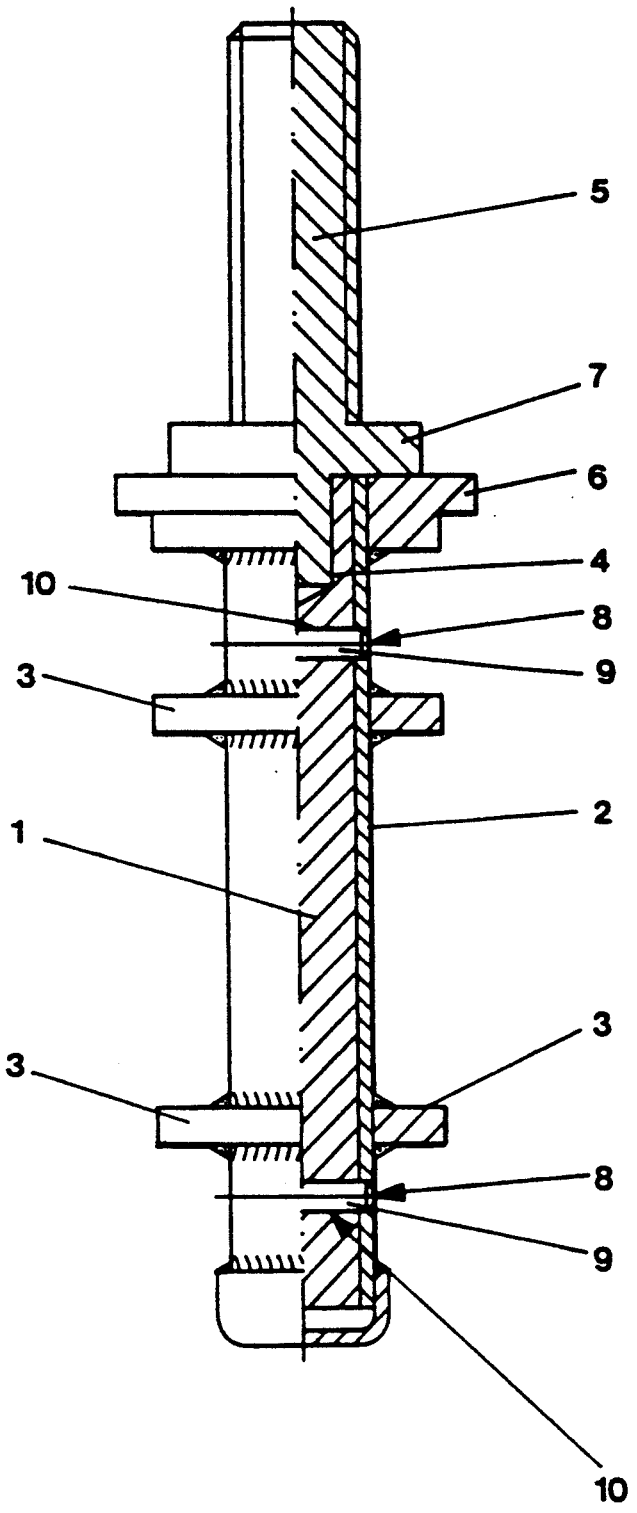
5
7
6
4
10
8
9
3
2
1
3
3
8
9
10

POWER LEAD FOR AN ELECTRODE

This application is a continuation of application Ser. No. 07/730,627, filed Jul. 16, 1991, now abandoned.

FIELD OF THE INVENTION

The invention relates to a power lead for an electrode of an electrochemical cell, which has a core of a material with good electrical conductivity that is supported, with large-area contact, by a tubular valve metal body; the surface of the valve metal body remote from the core is connected to the electrode, and the core has a recess to receive a contact pin.

BACKGROUND

German Patent Disclosure Document 30 11 643 and corresponding U.S. Pat. No. 4,409,086, HAAS et al., disclose an electrolysis apparatus with cell chambers through which the electrolyte flows. Anodes in the form of plate packets are disposed in these chambers via current-carrying center pins, each between two cathode plate packets; the electrode plates, which are offset from one another, each protrude into the plate gaps of opposite polarity, and the center pins comprise a core of highly conductive copper with a jacket coating of titanium. The center pins have contact straps on their outer jacket that serve to secure the anode plates and comprise platinum-plated titanium. The copper core of the center pins is provided with a bore, into which a screw body provided for establishing electrical contact is introduced.

Another similar arrangement is known from U.S. Pat. No. 3,940,328, THOMAS et al., in which a tubular valve metal body surrounds a hollow-cylindrical copper core; by spot welding, the outer face of the jacket-like valve metal body is provided with connecting elements of expanded metal that are joined to the flat, dimensionally stable active electrode parts.

In these known arrangements, the bond between the copper and titanium may weaken over the course of time, either from the invasion of air with attendant heating, from heating caused by an overflow or heating upon reactivation of anodes, or from aging; the result is an increase in the voltage drop. Previously, if predetermined threshold values for the voltage drop were exceeded, then the relatively expensive removal of the power lead from the active parts of the electrode was necessary.

THE INVENTION

An object of the invention is to improve the transfer of power between the core and the jacket conductor of a power lead for anodes.

Briefly, this is achieved by providing the valve metal body with an opening through which a metal pin is introduced into a recess of the core; at least the surface adjacent the opening 8 in the installed state is of valve metal, and the rim of the opening is welded in a hermetically sealed manner to the metal pin. "Valve metal" in this context means titanium, a titanium-based alloy, tantalum, a tantalum-based alloy, niobium or a niobium-based alloy.

In a preferred embodiment, the metal pin and the bore in the core have a cylindrical surface, and the diameter of the metal pin matches that of the bore. The metal pin is secured in the bore with a snug fit.

One advantage of the invention is that it is possible to improve the power transfer between the core and the valve metal body not only when new power leads are constructed but also in already-installed electrodes or, in other words, when repairs are made. Because so many electrolysis cells are typically used in industrial electrolysis systems, it is thus possible to achieve great energy economy by even only slightly reducing the voltage drop per electrode.

The invention is described in further detail below in conjunction with the drawing.

DRAWING

The single figure of the drawing shows a power lead, seen partly in longitudinal section.

DETAILED DESCRIPTION

In the drawing figure, the power lead is formed by a cylindrical core 1 of copper, a copper alloy, aluminum or an aluminum alloy which is provided with a jacket-like coating forming a valve metal body 2. The valve metal body 2 is preferably of titanium and has welded contact straps 3 of titanium, which provide connection with the anode plates, not shown here, and are firmly joined to them electrically and mechanically, by means of screw devices, for instance. Located along the longitudinal axis of the core in the upper portion of the power lead is a thread 4, into which is inserted a screw body 5 of a material of good electrical conductivity, with a surface coating that is inert to the electrolyte; the screw body 5 provides electrical connection of the power lead to the power supply system. The flange 6 encompassing the power lead in its upper region serves, in conjunction with the flange 7 of the threaded pin, to seal off the threaded opening in the copper core.

In the region of both ends, the valve body 2 of the power lead has openings 8 through which the cylindrical metal pins 9 of titanium are driven into bores 10 of the core 1. The pins 9 fit snugly in the bore 10, so that the entire jacket surface of the pins 9 serves to transfer power. In the region of the openings 8 of the valve metal body 2, the outwardly oriented ends of the pins 9 are welded in a hermetically sealed manner to the valve metal body. In this way, from the region of the core, the current is carried to the valve metal body 2 via the metal pins 9 through the spot welds in the region of the opening 8, and from there is passed on to the contact straps 3 and to the electrodes.

Prior to installation, the metal pin 9 has a slightly larger diameter than the bore 10 receiving it in the core 1. The metal pin 9 is introduced into the bore 10 by hammering; after the pin 9 is countersunk into the opening 8 of the valve metal jacket 2, a hermetically sealed welded connection is established by welding between the pin 9 and the rim of the opening 8.

Various changes and modifications may be made, and features described in connection with any one of the embodiments may be used with any of the others, within the scope of the inventive concept.

We claim:

1. A power lead for an anode electrode of an electrochemical cell comprising:

an elongated core (1) made of a material with good electrical conductivity;

a tubular valve metal body (2) having an inner surface which is adjacent said core (1) and an outer surface which is connected to said electrode, said tubular valve metal body (2) surrounding said core (1) over at least a major portion of the length of said core (1) for supporting said core (1) and having a large area of contact between the inner surface of said tubular valve metal body (2) and said core (1);

a pair of spaced apart contact straps (3), each of said contact straps (3) are attached at substantially a right angle to said tubular valve metal body so as to define a space between said contact straps (3), said contact straps (3) are made of a valve metal, and said contact straps (3) are connected to an anode;

a pair of metal contact pins (9);

said core (1) having a pair of recesses (10) to respectively receive each of said metal contact pins (9) therein, said recesses being disposed in an area outside of the space between said contact straps (3);

said tubular valve metal body (2) having a pair of openings (8) in registration with each of said recesses (10) and through which each said metal contact pin (9) is introduced so as to be received in a respective recess (10) of said core (1);

each of said metal contact pins (9) when received in each of said recesses (10) are disposed in an area outside of the space between said contact straps (3);

at least an outer surface portion of each of said metal contact pins (9) are made of a valve metal; and a rim portion of said tubular valve metal body (2) adjacent said opening (8) are welded to said valve metal outer surface portion of each of said metal contact pins (9) in a hermetically sealed manner.

2. The power lead of claim 1, wherein said metal contact pins (9) are made entirely of said valve metal.

3. The power lead of claim 2, wherein said tubular valve metal body (2) each of and said metal contact pins (9) are each made of a valve metal selected from the group consisting of titanium, a titanium alloy, tantalum, a tantalum alloy, niobium and a niobium alloy.

4. The power lead of claim 3, wherein the core (1) is made of a metal selected from the group consisting of copper, a copper alloy, aluminum and an aluminum alloy.

5. The power lead of claim 4, wherein each of said metal contact pins (2) and said recesses (10) in said core (1) each have a cylindrical surface and each of said metal contact pins (9) has a diameter which matches the diameter of the recesses (10).

6. The power lead of claim 5, wherein said pair of metal contact pins (9) are longitudinally spaced apart from each other.

7. The power lead of claim 6, wherein the outermost each of said metal contact pin (9) when received in said recesses (10) is substantially flush with the outer surface of said tubular valve metal body (2).

8. The power lead of claim 7, wherein the tubular valve metal body (2) and the outermost each of said metal contact pins (9) are each made of titanium.

9. The power lead of claim 2, wherein said core (1) is made of a metal selected from the group consisting of copper, a copper alloy, aluminum, and an aluminum alloy.

10. The power lead of claim 1, wherein said tubular valve metal body (2) and said outer surface portion of each of said metal contact pins (9) are each made of a valve metal selected from the group consisting of titanium, a titanium alloy, tantalum, a tantalum alloy, niobium and a niobium alloy.

11. The power lead of claim 10, wherein the core (1) is made of a metal selected from the group consisting of copper, a copper alloy, aluminum and an aluminum alloy.

12. The power lead of claim 1, wherein said core (1) is made of a metal selected from the group consisting of copper, a copper alloy, aluminum and an aluminum alloy.

* * * * *